US012612707B2

(12) United States Patent
Kitagawa et al.

(10) Patent No.: US 12,612,707 B2
(45) Date of Patent: Apr. 28, 2026

(54) ELECTROCHEMICAL REACTION DEVICE AND VALUABLE MATERIAL MANUFACTURING SYSTEM

(71) Applicant: KABUSHIKI KAISHA TOSHIBA, Tokyo (JP)

(72) Inventors: Ryota Kitagawa, Setagaya (JP); Yusuke Kofuji, Yokohama (JP); Asahi Motoshige, Ota (JP); Masakazu Yamagiwa, Yokohama (JP); Jun Tamura, Chuo (JP); Yuki Kudo, Yokohama (JP); Akihiko Ono, Kita (JP); Satoshi Mikoshiba, Yamato (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 24 days.

(21) Appl. No.: 18/397,131

(22) Filed: Dec. 27, 2023

(65) Prior Publication Data

US 2024/0124995 A1 Apr. 18, 2024

Related U.S. Application Data

(63) Continuation of application No. 16/811,697, filed on Mar. 6, 2020, now abandoned.

(30) Foreign Application Priority Data

Sep. 17, 2019 (JP) ..... 2019-168883

(51) Int. Cl.
*C25B 9/00* (2021.01)
*C25B 1/00* (2021.01)
(Continued)

(52) U.S. Cl.
CPC ..... *C25B 15/02* (2013.01); *C25B 1/00* (2013.01); *C25B 3/25* (2021.01); *C25B 9/19* (2021.01)

(58) Field of Classification Search
CPC .. C25B 15/02; C25B 3/25; C25B 9/19; C25B 1/00
See application file for complete search history.

(56) References Cited

U.S. PATENT DOCUMENTS 4,952,298 A 8/1990 Bouche-Pillon
2006/0211777 A1 9/2006 Severinsky
(Continued)

FOREIGN PATENT DOCUMENTS

CN 105695319 A 6/2016
CN 108624905 A 10/2018
(Continued)

*Primary Examiner* — Zulmariam Mendez
(74) *Attorney, Agent, or Firm* — Oblon, McClelland, Maier & Neustadt, L.L.P.

(57) ABSTRACT

An electrochemical reaction device in an embodiment includes: an electrochemical reaction cell including a first accommodation part for accommodating carbon dioxide, a second accommodation part for accommodating an electrolytic solution containing water, or water vapor, a diaphragm provided between the first accommodation part and the second accommodation part, a reduction electrode arranged in the first accommodation part, and an oxidation electrode arranged in the second accommodation part; a detection unit detecting a reaction amount in the electrochemical reaction cell; a regulation unit regulating an amount of the carbon dioxide to be supplied to the first accommodation part; and a control unit controlling the regulation unit based on a detection signal of the detection unit.

10 Claims, 7 Drawing Sheets

(51) Int. Cl.

| | |
|---|---|
| ***C25B 3/25*** | (2021.01) |
| ***C25B 9/19*** | (2021.01) |
| ***C25B 15/02*** | (2021.01) |

(56) References Cited

U.S. PATENT DOCUMENTS

| | | | | |
|---|---|---|---|---|
| 2011/0114502 | A1 | 5/2011 | Cole et al. | |
| 2014/0131217 | A1 | 5/2014 | Buschmann | |
| 2014/0291162 | A1 | 10/2014 | Sala et al. | |
| 2015/0090602 | A1 | 4/2015 | Sato | |
| 2016/0145751 | A1 | 5/2016 | Sato | |
| 2017/0167038 | A1 | 6/2017 | Hashiba | |
| 2017/0183789 | A1 * | 6/2017 | Matthews | C25B 9/19 |
| 2018/0261860 | A1 | 9/2018 | Jahnke | |
| 2018/0265440 | A1 | 9/2018 | Kudo et al. | |
| 2018/0274109 | A1 | 9/2018 | Kudo et al. | |
| 2019/0078222 | A1 | 3/2019 | Baldauf | |
| 2019/0085477 | A1 | 3/2019 | Ono et al. | |
| 2020/0036037 | A1 | 1/2020 | Krause | |
| 2020/0223775 | A1 | 7/2020 | Kudo et al. | |
| 2020/0255958 | A1 | 8/2020 | Lister | |
| 2021/0020975 | A1 | 1/2021 | Seymour | |
| 2021/0040631 | A1 | 2/2021 | Tanaka | |

FOREIGN PATENT DOCUMENTS

| | | | |
|---|---|---|---|
| DE | 10 2015 201 132 | A1 | 7/2016 |
| DE | 10 2015 214 592 | A1 | 2/2017 |
| EP | 3 375 907 | A1 | 9/2018 |
| EP | 3 378 968 | A1 | 9/2018 |
| JP | 2013-536319 | A | 9/2013 |
| JP | 2014-528519 | A | 10/2014 |
| JP | 2018-150595 | A | 9/2018 |
| JP | 2018-154901 | A | 10/2018 |
| JP | 2019-56135 | A | 4/2019 |
| KR | 101791663 | B1 | 10/2017 |
| WO | WO 2012/015905 | A1 | 2/2012 |
| WO | WO 2017/021083 | A1 | 2/2017 |

* cited by examiner

ELECTROCHEMICAL REACTION DEVICE AND VALUABLE MATERIAL MANUFACTURING SYSTEM

CROSS-REFERENCE TO RELATED APPLICATION

This application is a continuation of and claims benefit under 35 U.S.C. § 120 to U.S. application Ser. No. 16/811,697, filed Mar. 6, 2020, which is based upon and claims the benefit of priority under 35 U.S.C. § 119 from Japanese Patent Application No. 2019-168883, filed Sep. 17, 2019, the entire contents of each of which are incorporated herein by reference.

FIELD

Embodiments described herein relate generally to an electrochemical reaction device and a valuable material manufacturing system using the same.

BACKGROUND

In recent years, there is a concern over depletion of fossil fuel such as petroleum and coal, and expectations of sustainable renewable energy increase. From viewpoints of not only such energy problems but also environmental problems and so on, an artificial photosynthesis technology which electrochemically reduces carbon dioxide by using renewable energy such as sunlight to generate a stockable chemical energy source, is under development. An electrochemical reaction device realizing the artificial photosynthesis technology includes, for example, an oxidation electrode that oxidizes water ($H_2O$) to produce oxygen ($O_2$), and a reduction electrode that reduces carbon dioxide ($CO_2$) to produce a carbon compound. The oxidation electrode and the reduction electrode of the electrochemical reaction device are connected to a power supply derived from renewable energy such as solar power generation, hydroelectric power generation, wind power generation, or geothermal power generation.

The reduction electrode of the electrochemical reaction device is arranged, for example, to be immersed in water in which $CO_2$ is dissolved or to be brought into contact with water which flows through a flow path and in which $CO_2$ is dissolved. The reduction electrode obtains reduction potential for $CO_2$ from the power supply derived from renewable energy, and thereby reducing $CO_2$ to produce carbon compounds such as carbon monoxide (CO), formic acid (HCOOH), methanol ($CH_3OH$), methane ($CH_4$), ethanol ($C_2H_5OH$), ethane ($C_2H_6$), ethylene ($C_2H_4$), and ethylene glycol ($C_2H_6O_2$).

In the case of electrochemically reducing $CO_2$ using the above-described renewable energy, there is a problem that power is likely to fluctuate due to the change in weather, wind condition, or the like. In accordance with such fluctuation in power, a reaction amount of $CO_2$ in an electrochemical reaction device is likely to change, and a concentration of an unreacted $CO_2$ gas in a produced gas is likely to fluctuate. When a valuable material such as gasoline, jet fuel, or methanol is manufactured by using gas produced in an electrochemical reaction device, for example, a concentration fluctuation of an unreacted $CO_2$ gas in a produced gas becomes a factor of reducing manufacturability, a manufacturing efficiency, and the like of the valuable material. In order to avoid such a problem, a measure is conventionally taken such that a device of separating a $CO_2$ gas in a produced gas is provided at a subsequent stage of an electrochemical reaction device, to thereby regulate a $CO_2$ gas concentration. However, the regulation of the $CO_2$ gas concentration is a factor of increasing a device cost as not only an electrochemical reaction device but also an entire valuable material manufacturing system, increasing a manufacturing cost of the valuable material, and reducing a manufacturing efficiency and the like of the valuable material.

DETAILED DESCRIPTION

An electrochemical reaction device in an embodiment includes: an electrochemical reaction cell including a first accommodation part for accommodating carbon dioxide, a second accommodation part for accommodating an electrolytic solution containing water, or water vapor, a diaphragm provided between the first accommodation part and the second accommodation part, a reduction electrode to arrange in the first accommodation part, and an oxidation electrode to arrange in the second accommodation part; a detection unit configured to detect a reaction amount in the electrochemical reaction cell; a regulation unit configured to regulate an amount of the carbon dioxide to be supplied to the first accommodation part; and a control unit configured to control the regulation unit based on a detection signal of the detection unit.

Electrochemical reaction devices and a valuable material manufacturing system in embodiments will be described hereinafter with reference to the drawings. In the respective embodiments to be described below, substantially the same components are denoted by the same reference signs, and description thereof is partially omitted in some cases. The drawings are schematic, and the relationship between thicknesses and plane dimensions, ratios between thicknesses of respective parts and the like differ from actual ones in some cases.

First Embodiment

Figure 1:
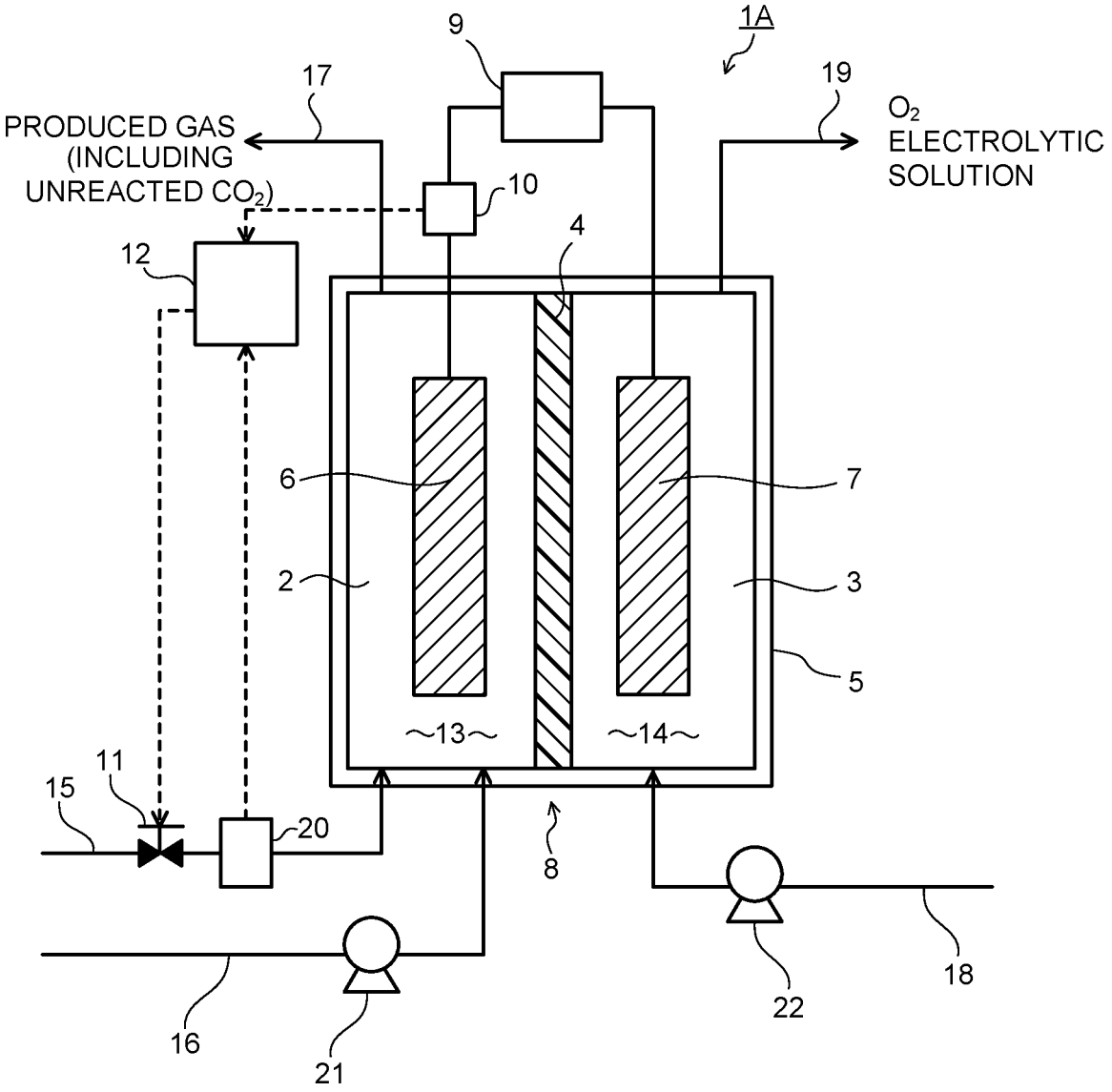
FIG. 1 is a view illustrating an electrochemical reaction device in a first embodiment.

FIG. 1 is a view illustrating an electrochemical reaction device 1 (1A) in a first embodiment. The electrochemical reaction device 1A illustrated in FIG. 1 includes: an electrochemical reaction cell 8 including a reaction vessel 5 including a first accommodation part (accommodation vessel) 2 for accommodating $CO_2$, a second accommodation part (accommodation vessel) 3 for accommodating a second electrolytic solution containing water, or water vapor, and a diaphragm 4, a reduction electrode (cathode) 6 arranged in the first accommodation part 2, and an oxidation electrode (anode) 7 arranged in the second accommodation part 3; a power supply 9 connected to the reduction electrode 6 and the oxidation electrode 7; a detection unit 10 detecting a reaction amount in the electrochemical reaction cell 8; a regulation unit 11 regulating an amount of $CO_2$ to be supplied to the first accommodation part 2; and a control unit 12 controlling the regulation unit 11 based on a detection signal of the detection unit 10. Hereinafter, the respective units will be described in detail.

The reaction vessel 5 is separated into two chambers by the diaphragm 4 capable of moving ions such as hydrogen ions ($H^+$) and hydroxide ions ($OH^-$), and has the first accommodation part 2 and the second accommodation part 3. The reaction vessel 5 may be made of, for example, quartz white plate glass, polystyrol, polymethacrylate or the like. A material transmitting light may be used for a part of the reaction vessel 5, and a resin material may be used for the remainder. Examples of the resin material include polyetheretherketone (PEEK), polyamide (PA), polyvinylidene fluoride (PVDF), polyacetal (POM) (copolymer), polyphenyleneether (PPE), acrylonitrile-butadiene-styrene copolymer (ABS), polypropylene (PP), polyethylene (PE), and so on.

In the first accommodation part 2, the reduction electrode 6 is arranged, and further, $CO_2$ is accommodated. $CO_2$ is accommodated in the first accommodation part 2 as a first electrolytic solution 13 containing the $CO_2$, for example. The first electrolytic solution 13 functions as a reduction electrode solution (cathode solution), and contains carbon dioxide ($CO_2$) as a substance to be reduced. Here, a state of $CO_2$ that exists in the first electrolytic solution 13 is not required to be a gaseous state, and it may be a state of dissolved $CO_2$, carbonate ions ($CO_3^{2-}$), hydrogen carbonate ions ($HCO_{3-}$), or the like. The first electrolytic solution 13 may contain hydrogen ions, and is preferably an aqueous solution. In the second accommodation part 3, the oxidation electrode 7 is arranged, and further, a second electrolytic solution 14 containing water is accommodated. The second electrolytic solution 14 functions as an oxidation electrode solution (anode solution), and contains water ($H_2O$), chloride ions ($Cl^-$), and the like, for example, as a substance to be oxidized. The second electrolytic solution 14 may be an alcohol aqueous solution, an aqueous solution of an organic substance such as amine, or the like.

By changing the amount of water and electrolytic solution components contained in the first and second electrolytic solutions 13, 14, it is possible to change the reactivity, to thereby change the selectivity of the substance to be reduced and the proportion of the chemical substance to be produced. The first and second electrolytic solutions 13, 14 may contain redox couples according to need. As the redox couple, there can be cited, for example, $Fe^{3+}/Fe^{2+}$ and $IO^{3-}/I^-$. To the first accommodation part 2, a gas supply flow path 15 which supplies a raw material gas containing $CO_2$ and a first liquid supply flow path 16 which supplies the first electrolytic solution 13 are connected, and further, a first gas and liquid discharge flow path 17 which discharges a reactive gas and the first electrolytic solution 13 is connected. To the second accommodation part 3, a second liquid supply flow path 18 which supplies the second electrolytic solution 14 is connected, and further, a second gas and liquid discharge flow path 19 is connected. The first and second accommodation parts 2, 3 may include space parts for accommodating gas contained in the reactant and the product.

The gas supply flow path 15 is provided with the regulation unit 11 which regulates an amount of the raw material gas containing $CO_2$ to be supplied to the first accommodation part 2. As the regulation unit 11, for example, a variable throttle, a flow rate control valve or the like is used. The gas supply flow path 15 is further provided with a flowmeter 20. Specifically, it is designed such that a flow rate of the raw material gas that flows through the gas supply flow path 15 can be controlled by the regulation unit 11, and further, the controlled flow rate of the raw material gas can be measured. The first liquid supply flow path 16 is provided with a pump 21 that feeds the first electrolytic solution 13 to the first accommodation part 2. The second liquid supply flow path 18 is provided with a pump 22 that feeds the second electrolytic solution 14 to the second accommodation part 3. To the first and second gas and liquid discharge flow paths 17, 19, a gas/liquid separator that separates the produced gas and the electrolytic solutions or the like may also be connected.

The pressure in each of the first and second accommodation parts 2, 3 is preferably set to a pressure which does not liquefy $CO_2$, and concretely, it is preferably regulated to fall within a range of 0.1 MPa or more and 6.4 MPa or less. If the pressure in each of the accommodation parts 2, 3 is less than 0.1 MPa, the reduction reaction efficiency of $CO_2$ may decrease. If the pressure in each of the accommodation parts 2, 3 exceeds 6.4 MPa, $CO_2$ is liquefied, and the reduction reaction efficiency of $CO_2$ may decrease. Note that there is a case where breakage or the like of the diaphragm 4 occurs due to a differential pressure between the first accommodation part 2 and the second accommodation part 3. For this reason, the difference between the pressure in the first accommodation part 2 and the pressure in the second accommodation part 3 (differential pressure) is preferably set to 0.5 MPa or less.

The lower the temperature of the electrolytic solutions 13, 14, the higher the amount of dissolution of $CO_2$, but, from a viewpoint of electrochemical reaction, at a low temperature, a solution resistance becomes high and a theoretical voltage of the reaction becomes high, which is disadvantageous. On the other hand, when the temperature of the electrolytic solutions 13, 14 is high, this is advantageous in terms of electrochemical reaction, although the amount of dissolution of $CO_2$ becomes low. For this reason, a working temperature condition of the electrochemical reaction cell 8 is preferably in a middle temperature region, for example, in a range of an atmospheric temperature or more and equal to or less than a boiling point of the electrolytic solutions 13, 14. When the electrolytic solutions 13, 14 are aqueous solutions, the working temperature condition is preferably 10° C. or more and 100° C. or less, and more preferably 25° C. or more and 80° C. or less. When the raw material gas containing $CO_2$ is filled in the first accommodation part 2 and water vapor is filled in the second accommodation part 3, the operation at a higher temperature becomes possible. In that case, the working temperature is decided by taking heat resistance of a membrane such as the diaphragm 4 into consideration. When the diaphragm 4 is an ion exchange membrane or the like, the working temperature is 180° C. at the maximum, and when it is a polymer porous membrane such as Teflon (registered trademark), the maximum temperature becomes 300° C.

The first electrolytic solution 13 and the second electrolytic solution 14 may be electrolytic solutions containing different substances or may be electrolytic solutions containing the same substance. When the first electrolytic solution 13 and the second electrolytic solution 14 contain the same substance and the same solvent, the first electrolytic solution 13 and the second electrolytic solution 14 may be regarded as one electrolytic solution. The pH of the second electrolytic solution 14 is preferably higher than the pH of the first electrolytic solution 13. This makes ions such as hydrogen ions and hydroxide ions easy to move via the diaphragm 4. The liquid junction potential due to the difference in pH can effectively promote the oxidation-reduction reaction.

The first electrolytic solution 13 is preferably a solution with high absorptance of $CO_2$. The existing form of $CO_2$ in the first electrolytic solution 13 is not always limited to a state of being dissolved therein, and $CO_2$ in an air bubble state may exist by being mixed in the first electrolytic solution 13. As the electrolytic solution containing $CO_2$, for example, there can be cited aqueous solutions containing hydrogencarbonates and carbonates such as lithium hydrogen carbonate ($LiHCO_3$), sodium hydrogen carbonate ($NaHCO_3$), potassium hydrogen carbonate ($KHCO_3$), cesium hydrogen carbonate ($CsHCO_3$), sodium carbonate ($Na_2CO_3$), and potassium carbonate ($K_2CO_3$), phosphoric acid, boric acid, and so on. The electrolytic solution containing $CO_2$ may contain alcohols such as methanol, ethanol, and acetone, or may be an alcohol solution. The first electrolytic solution 13 may be an electrolytic solution containing a $CO_2$ absorbent that lowers the reduction potential for $CO_2$, has high ion conductivity, and absorbs $CO_2$.

As the second electrolytic solution 14, a solution using water ($H_2O$), for example, an aqueous solution containing an arbitrary electrolyte can be used. This solution is preferably an aqueous solution that promotes the oxidation reaction of water. As the aqueous solution containing the electrolyte, for example, there can be cited aqueous solutions containing phosphate ion ($PO_4^{2-}$), borate ion ($BO_3^{3-}$), sodium ion ($Na^+$), potassium ion ($K^+$), calcium ion ($Ca^{2+}$), lithium ion ($Li^+$), cesium ion ($Cs^+$), magnesium ion ($Mg^{2+}$), chloride ion ($Cl^-$), hydrogen carbonate ion ($HCO_3^-$), carbonate ion ($CO_3^-$), hydroxide ion ($OH^-$), and the like.

As the above-described electrolytic solutions 13,14, for example, ionic liquids made of salts of cations such as imidazolium ions or pyridinium ions and anions such as $BF_4^-$ or $PF_6^-$ and in a liquid state in a wide temperature range, or aqueous solutions thereof can be used. Further, as other electrolytic solutions, there can be cited amine solutions such as ethanolamine, imidazole, and pyridine, and aqueous solutions thereof. As amine, there can be cited primary amine, secondary amine, tertiary amine, and so on. These electrolytic solutions may be high in ion conductivity and have properties of absorbing carbon dioxide and characteristics of lowering the reduction energy.

As the primary amine, there can be cited methylamine, ethylamine, propylamine, butylamine, pentylamine, hexylamine, and the like. Hydrocarbons of the amine may be substituted by alcohol, halogen, and the like. As amine whose hydrocarbons are substituted, there can be cited methanolamine, ethanolamine, chloromethylamine, and the like. Further, an unsaturated bond may exist. These hydrocarbons are also the same in the secondary amine and the tertiary amine.

As the secondary amine, there can be cited dimethylamine, diethylamine, dipropylamine, dibutylamine, dipentylamine, dihexylamine, dimethanolamine, diethanolamine, dipropanolamine, and the like. The substituted hydrocarbons may be different. This also applies to the tertiary amine. Examples with different hydrocarbons include methylethylamine, methylpropylamine, and the like.

As the tertiary amine, there can be cited trimethylamine, triethylamine, tripropylamine, tributylamine, trihexylamine, trimethanolamine, triethanolamine, tripropanolamine, tributanolamine, triexanolamine, methyldiethylamine, methyldipropylamine, and the like.

As the cation of the ionic liquid, there can be cited 1-ethyl-3-methylimidazolium ion, 1-methyl-3-propylimidazolium ion, 1-butyl-3-methylimidazole ion, 1-methyl-3-pentylimidazolium ion, 1-hexyl-3-methylimidazolium ion, and the like.

A second place of the imidazolium ion may be substituted. As the cation of the imidazolium ion whose second place is substituted, there can be cited 1-ethyl-2,3-dimethylimidazolium ion, 1,2-dimethyl-3-propylimidazolium ion, 1-butyl-2,3-dimethylimidazolium ion, 1,2-dimethyl-3-pentylimidazolium ion, 1-hexyl-2,3-dimethylimidazolium ion, and the like.

As the pyridinium ion, there can be cited methylpyridinium, ethylpyridinium, propylpyridinium, butylpyridinium, pentylpyridinium, hexylpyridinium, and the like. In both of the imidazolium ion and the pyridinium ion, an alkyl group may be substituted, or an unsaturated bond may exist.

As the anion, there can be cited fluoride ion ($F^-$), chloride ion ($Cl^-$), bromide ion ($Br^-$), iodide ion ($I^-$), $BF_4^-$, $PF_6^-$, $CF_3COO^-$, $CF_3SO_3^-$, $NO_3^-$, $SCN^-$, $(CF_3SO_2)_3C^-$, bis(trifluoromethoxysulfonyl)imide, bis(trifluoromethoxysulfonyl) imide, and the like. Dipolar ions in which the cations and the anions of the ionic liquid are coupled by hydrocarbons may be used. Note that a buffer solution such as a potassium phosphate solution may be supplied to the accommodation parts 2, 3.

For the diaphragm 4, a membrane capable of selectively allowing the anion or the cation to pass therethrough is used. This makes it possible to make the electrolytic solutions 13, 14 which are brought in contact with the reduction electrode 6 and the oxidation electrode 7, respectively, to be electrolytic solutions containing different substances, and to promote the reduction reaction and the oxidation reaction depending on the difference in ionic strength, the difference in pH or the like. The first electrolytic solution 13 and the second electrolytic solution 14 can be separated by using the diaphragm 4. The diaphragm 4 may have a function of allowing a part of ions contained in the electrolytic solutions 13, 14 in which both the electrodes 6, 7 are immersed to be transmitted therethrough, namely, a function of blocking one or more kinds of ions contained in the electrolytic solutions 13, 14. This can differ, for example, the pH or the like between the two electrolytic solutions 13, 14.

As the diaphragm 4, for example, an ion exchange membrane such as NEOSEPTA (registered trademark) of ASTOM Corporation, Selemion (registered trademark), Aciplex (registered trademark) of ASAHI GLASS CO., LTD., Fumasep (registered trademark), fumapem (registered trademark) of Fumatech GmbH, Nafion (registered trademark) being fluorocarbon resin made by sulfonating and polymerizing tetrafluoroethylene of E.I. du Pont de Nemours and Company, lewabrane (registered trademark) of LANXESS AG, IONSEP (registered trademark) of IONTECH Inc., Mustang (registered trademark) of PALL Corporation, ralex (registered trademark) of mega Corporation, Gore-Tex (registered trademark) of Gore-Tex Co., Ltd. or the like can be used. Besides, the ion exchange membrane may be composed by using a membrane having hydrocarbon as a basic skeleton or a membrane having an amine group in anion exchange. When the first electrolytic solution 13 and the second electrolytic solution 14 are different in pH, the electrolytic solutions can be used while stably keeping their pHs by using a bipolar membrane made by stacking a cation exchange membrane and an anion exchange membrane.

Other than the ion exchange membrane, for example, porous membranes of a silicone resin, fluorine-based resins (perfluoroalkoxyalkane (PFA), perfluoroethylene propene copolymer (FEP), polytetrafluoroethylene (PTFE), ethylene-tetrafluoroethylene copolymer (ETFE), polyvinylidene fluoride (PVDF), polychlorotrifluoroethylene (PCTFE), ethylene-chlorotrifluoroethylene copolymer (ECTFE) and the like), and ceramics, packing filled with glass filter, agar, and the like, insulating porous bodies of zeolite and oxide and the like may be used as the diaphragm 4. In particular, a hydrophilic porous membrane never causes clogging due to air bubbles, so that it is preferable as the diaphragm 4.

The reduction electrode 6 is an electrode (cathode) that reduces carbon dioxide ($CO_2$) to produce a carbon compound. The reduction electrode 6 is arranged in the first accommodation part 2 and immersed in the first electrolytic solution 13. The reduction electrode 6 contains a reduction catalyst for producing the carbon compound by the reduction reaction of, for example, carbon dioxide. As the reduction catalyst, there can be cited a material that lowers activation energy for reducing carbon dioxide. In other words, a material that lowers an overvoltage when the carbon compound is produced by the reduction reaction of carbon dioxide, can be cited.

As the reduction electrode 6, for example, a metal material or a carbon material can be used. As the metal material, for example, a metal such as gold, aluminum, copper, silver, platinum, palladium, zinc, mercury, indium, nickel, or titanium, an alloy containing the metal, or the like can be used. As the carbon material, for example, graphene, carbon nanotube (CNT), fullerene, ketjen black, or the like can be used. Note that the reduction catalyst is not limited to the above, and it is possible to use, for example, a metal complex such as a Ru complex or a Re complex, or an organic molecule having an imidazole skeleton or a pyridine skeleton, as the reduction catalyst. The reduction catalyst may be a mixture of a plurality of materials. The reduction electrode 6 may have, for example, a structure having the reduction catalyst in a thin film shape, a mesh shape, a particle shape, a wire shape, or the like provided on a conductive substrate.

The carbon compound produced by the reduction reaction at the reduction electrode 6 differs depending on the kind or the like of the reduction catalyst, and examples thereof include carbon monoxide (CO), formic acid (HCOOH), methane ($CH_4$), methanol ($CH_3OH$), ethane ($C_2H_6$), ethylene ($C_2H_4$), ethanol ($C_2H_5OH$), formaldehyde (HCHO), ethylene glycol ($C_2H_6O_2$), and so on. Further, at the reduction electrode 6, a side reaction of generating hydrogen ($H_2$) by the reduction reaction of water ($H_2O$) may occur at the same time with the reduction reaction of carbon dioxide ($CO_2$).

The oxidation electrode 7 is an electrode (anode) that oxidizes a substance to be oxidized such as a substance, ions, and so on in the second electrolytic solution 14. For example, the oxidation electrode 7 oxidizes water ($H_2O$) to produce oxygen or hydrogen peroxide solution, or it oxidizes chloride ions ($Cl^-$) to produce chlorine. The oxidation electrode 7 is arranged in the second accommodation part 3, and immersed in the second electrolytic solution 14. The oxidation electrode 7 contains an oxidation catalyst for the substance to be oxidized. As the oxidation catalyst, a material that lowers activation energy when oxidizing the substance to be oxidized, in other words, a material that lowers a reaction overvoltage is used.

As such oxidation catalyst material, there can be cited, for example, metals such as ruthenium, iridium, platinum, cobalt, nickel, iron, and manganese. Further, a binary metal oxide, a ternary metal oxide, a quaternary metal oxide, or the like can be used. As the binary metal oxide, there can be cited, for example, manganese oxide (Mn—O), iridium oxide (Ir—O), nickel oxide (Ni—O), cobalt oxide (Co—O), iron oxide (Fe—O), tin oxide (Sn—O), indium oxide (In—O), ruthenium oxide (Ru—O), and the like. As the ternary metal oxide, there can be cited, for example, Ni—Fe—O, Ni—Co—O, La—Co—O, Ni—La—O, Sr—Fe—O, and the like. As the quaternary metal oxide, there can be cited, for example, Pb—Ru—Ir—O, La—Sr—Co—O, and the like. Note that the oxidation catalyst is not limited to the above, and a metal hydroxide containing cobalt, nickel, iron, manganese, or the like, or a metal complex such as a Ru complex or a Fe complex can also be used as the oxidation catalyst. Further, a plurality of materials may be mixed to be used.

Further, the oxidation electrode 7 may be composed of a composite material containing both the oxidation catalyst and a conductive material. As the conductive material, for example, there can be cited: carbon materials such as carbon black, activated carbon, fullerene, carbon nanotube, graphene, ketjen black, and diamond, transparent conductive oxides such as indium tin oxide (ITO), zinc oxide (ZnO), fluorine-doped tin oxide (FTO), aluminum-doped zinc oxide (AZO), and antimony-doped tin oxide (ATO); metals such as Cu, Al, Ti, Ni, Ag, W, Co, and Au; and alloys each containing at least one of the metals. The oxidation electrode 7 may have, for example, a structure having the oxidation catalyst in a thin film shape, a mesh shape, a particle shape, a wire shape, or the like provided on a conductive substrate. As the conductive substrate, for example, a metal material containing titanium, titanium alloy, or stainless steel is used.

The power supply 9 is to supply power to make the electrochemical reaction cell 8 cause the oxidation-reduction reaction, and is electrically connected to the reduction electrode 6 and the oxidation electrode 7. The electric energy supplied from the power supply 9 is used to cause the reduction reaction by the reduction electrode 6 and the oxidation reaction by the oxidation electrode 7. The power supply 9 and the reduction electrode 6 are connected and the power supply 9 and the oxidation electrode 7 are connected, for example, by wiring. Between the electrochemical reaction cell 8 and the power supply 9, electric equipment such as an inverter, a converter, or a battery may be installed as needed. The drive system of the electrochemical reaction cell 8 may be a constant-voltage system or a constant-current system. The wiring for supplying power to the electrochemical reaction cell 8 from the power supply 9 is provided with the detection unit 10 that detects a reaction amount in the electrochemical reaction cell 8.

The power supply 9 may be a normally-used commercial power supply, battery or the like, or may be a power supply that supplies electric energy obtained by converting renewable energy. Examples of such power supply include a power supply that converts kinetic energy or potential energy of wind power, water power, geothermal power, tidal power or the like into electric energy, a power supply such as a solar cell including a photoelectric conversion element that converts light energy into electric energy, a power supply such as a fuel cell or a storage battery that converts chemical energy into electric energy, an apparatus that converts vibrational energy such as sound into electric energy, and so on. The photoelectric conversion element has a function of performing charge separation by light energy such as emitted sunlight. Examples of the photoelectric conversion element include a pin-junction solar cell, a pn-junction solar cell, an amorphous silicon solar cell, a multijunction solar cell, a single crystal silicon solar cell, a polycrystalline silicon solar cell, a dye-sensitized solar cell, an organic thin-film solar cell, and the like. Further, the photoelectric conversion element may be stacked on at least one of the reduction electrode 6 and the oxidation electrode 7 inside the reaction vessel 5.

The regulation unit 11 provided to the gas supply flow path 15 regulates the amount of raw material gas containing $CO_2$ to be supplied to the first accommodation part 2. By increasing/decreasing, with the use of the regulation unit 11, the amount of $CO_2$ to be supplied to the first accommodation part 2, it is possible to regulate a concentration of unreacted $CO_2$ in the gas discharged from the first accommodation part 2, namely, a utilization ratio of $CO_2$ gas. As will be described hereinafter in detail, even in a case where the power supplied to the electrochemical reaction cell 8 from the power supply 9 fluctuates and the amount of $CO_2$ consumed by the reduction reaction of $CO_2$ changes, it becomes possible to stabilize the $CO_2$ concentration in the produced gas by increasing/decreasing, with the use of the regulation unit 11, the amount of $CO_2$ to be supplied to the first accommodation part 2. Consequently, a mechanism or a process of regulating the $CO_2$ concentration in the produced gas discharged from the first accommodation part 2 is simplified or becomes unnecessary, resulting in that the cost for the electrochemical reaction device 1 and the valuable material manufacturing system can be reduced.

The control of the supply amount of the raw material gas containing $CO_2$ to be supplied to the inside of the first accommodation part 2, is performed in a manner that a detection signal indicating a reaction amount in the electrochemical reaction cell 8 detected by the detection unit 10, concretely, a detection signal indicating at least one of the amount and the kind of the substance produced at the reduction electrode 6, is sent to the control unit 12, and the control unit 12 controls the operation of the regulation unit 11. The detection unit 10 may be an analysis unit (analyzer) that performs gas analysis on the composition of at least one of the gas discharged from the first accommodation part 2 and the gas discharged from the second accommodation part 3, and further, it may also be a voltage and current monitoring unit that monitors at least one of the voltage and the current of the electrochemical reaction cell 8, for example, at least one of the voltage applied to the reduction electrode 6 and the oxidation electrode 7 and the current that flows through the reduction electrode 6 and the oxidation electrode 7, or an electrode potential monitoring unit that monitors the potential of the reduction electrode 6. Further, it is also possible to detect the reaction amount in the electrochemical reaction cell 8 by measuring the flow rate of the substance discharged from at least one of the first accommodation part 2 and the second accommodation part 3. The detection unit 10 is electrically connected to the control unit 12, and the control unit 12 is electrically connected to the regulation unit 11. The detection unit 10 outputs a signal based on the detection result to the control unit 12.

In the electrochemical reaction device 1A illustrated in FIG. 1, the detection unit 10 is provided with an ammeter that monitors a value of current that flows through the electrochemical reaction cell 8 from the power supply 9. A value of a cell current that flows through the electrochemical reaction cell 8 is one of factors that decide the reaction amount of the electrochemical reaction, so that by monitoring the current value, the amount and the composition of the substance produced from the reduction electrode 6 can be recognized. In the case of monitoring the cell current, the detection unit 10 is a signal outputting-type ammeter connected in series to the electrochemical reaction cell 8. In the case of monitoring the cell voltage, the detection unit 10 is a signal outputting-type voltmeter connected in parallel to the electrochemical reaction cell 8. When the detection unit 10 monitors the current and the voltage, the detection unit 10 may have a form incorporated in the power supply 9.

The control unit 12 is electrically connected to the regulation unit 11 and the detection unit 10. Further, the control unit 12 is electrically connected to the flowmeter 20. The control unit 12 receives the detection signal (data signal) from the detection unit 10, and outputs a control signal to the regulation unit 11 based on the detection signal. The control unit 12 previously stores a request criterion of the data signal transmitted from the detection unit 10, for example, a request criterion based on a correlation between the composition and the amount of the product, and the data signal, and based on the relationship between the request criterion and the data signal, the control signal is output to the regulation unit 11 from the control unit 12.

The control unit 12 is configured by a computer such as a PC or a microcomputer, for example, it arithmetically processes the data signal output from the detection unit 10, and controls the operation of the regulation unit 11 to regulate the flow rate of the raw material gas containing $CO_2$ to be supplied to the first accommodation part 2 so that the $CO_2$ concentration in the produced gas discharged from the first accommodation part 2 takes a desired value. At this time, in order to increase the accuracy of the flow rate regulation, it is preferable to provide a feedback mechanism in which the flowmeter 20 measures the flow rate of the raw material gas to be supplied to the first accommodation part 2, and the measured data is transmitted to the control unit 12, as illustrated in FIG. 1. Further, it is not limited to design such that each of the regulation unit 11 and the flowmeter 20 illustrated in FIG. 1 is independently functioned and provided, and it is also possible to use equipment such as a mass flow controller in which functions of measuring and regulating a flow rate of gas or liquid are integrally provided.

Further, it is also possible to design such that data obtained by converting temperature information inside the device such as one of the electrochemical reaction cell 8 or a pipe into signals, other than the signal from the detection unit 10, is input to the control unit 12. The temperature is a factor that exerts influence on the amount of gas or gaseous matter, so that by transmitting the output data which takes the temperature information into consideration to the regulation unit 11 from the control unit 12, it becomes possible to perform regulation with higher accuracy.

Next, the operation of the electrochemical reaction device 1A will be described. Here, a case of using an aqueous solution containing carbon dioxide and an aqueous potassium hydrogen carbonate solution as the electrolytic solutions 13, 14 to reduce carbon dioxide to mainly produce carbon monoxide, and oxidize water to produce oxygen will be described. When a voltage of a bath voltage or more is applied between the reduction electrode 6 and the oxidation electrode 7, the oxidation reaction of water ($H_2O$) occurs in the vicinity of the oxidation electrode 7 which is brought into contact with the second electrolytic solution 14. As expressed in the following Expression (1), the oxidation reaction of $H_2O$ contained in the second electrolytic solution 14 occurs, and electrons are lost and oxygen ($O_2$) and hydrogen ions ($H^+$) are produced. A part of the produced hydrogen ions ($H^+$) move through the diaphragm 4 into the first electrolytic solution 13.

$$2H_2O \rightarrow 4H^+ + O_2 + 4e^- \quad (1)$$

When the hydrogen ions ($H^+$) produced on the oxidation electrode 7 side reach the vicinity of the reduction electrode 6 and electrons ($e^-$) are supplied to the reduction electrode 6 from the power supply 9, the reduction reaction of carbon dioxide ($CO_2$) occurs. As expressed in the following Expression (2), $CO_2$ contained in the first electrolytic solution 13 is reduced by the hydrogen ions ($H^+$) moved to the vicinity of the reduction electrode 6 and the electrons ($e^-$) supplied from the power supply 9 to produce carbon monoxide (CO).

$$2CO_2 + 4H^+ + 4e^- \rightarrow 2CO + 2H_2O \quad (2)$$

Note that the reduction reaction of $CO_2$ is not limited to the CO production reaction, and may be a production reaction of ethanol ($C_2H_5OH$), ethylene ($C_2H_4$), ethane ($C_2H_6$), methane ($CH_4$), methanol ($CH_3OH$), acetic acid ($CH_3COOH$), propanol ($C_3H_7OH$), or the like.

The reduction reaction by the reduction electrode 6 fluctuates depending on an amount of power supplied by the power supply 9. For example, when the production reaction of CO gas described above occurs, the amount of $CO_2$ to be consumed changes according to the number of electrons (amount of current) flowing through the reduction electrode 6. For this reason, when a certain amount of $CO_2$ is supplied to the first accommodation part 2, the $CO_2$ concentration in the discharged gas is increased/decreased by the fluctuation in power. As described above, the fluctuation in the $CO_2$ concentration in the gas discharged from the first accommodation part 2 is monitored based on the signal detected by the detection unit 10. Subsequently, based on the monitoring result obtained by the detection unit 10, the regulation unit 11 is controlled, and the amount of raw material gas containing $CO_2$ to be supplied to the first accommodation part 2 is regulated. Consequently, the $CO_2$ concentration in the produced gas discharged from the first accommodation part 2 is regulated to take a desired value. Therefore, it becomes possible to suppress fluctuation with time in the concentration of unreacted $CO_2$ due to the fluctuation in the amount of supply power, to thereby enhance the availability and utility value of the produced gas.

Second Embodiment

Figure 2:
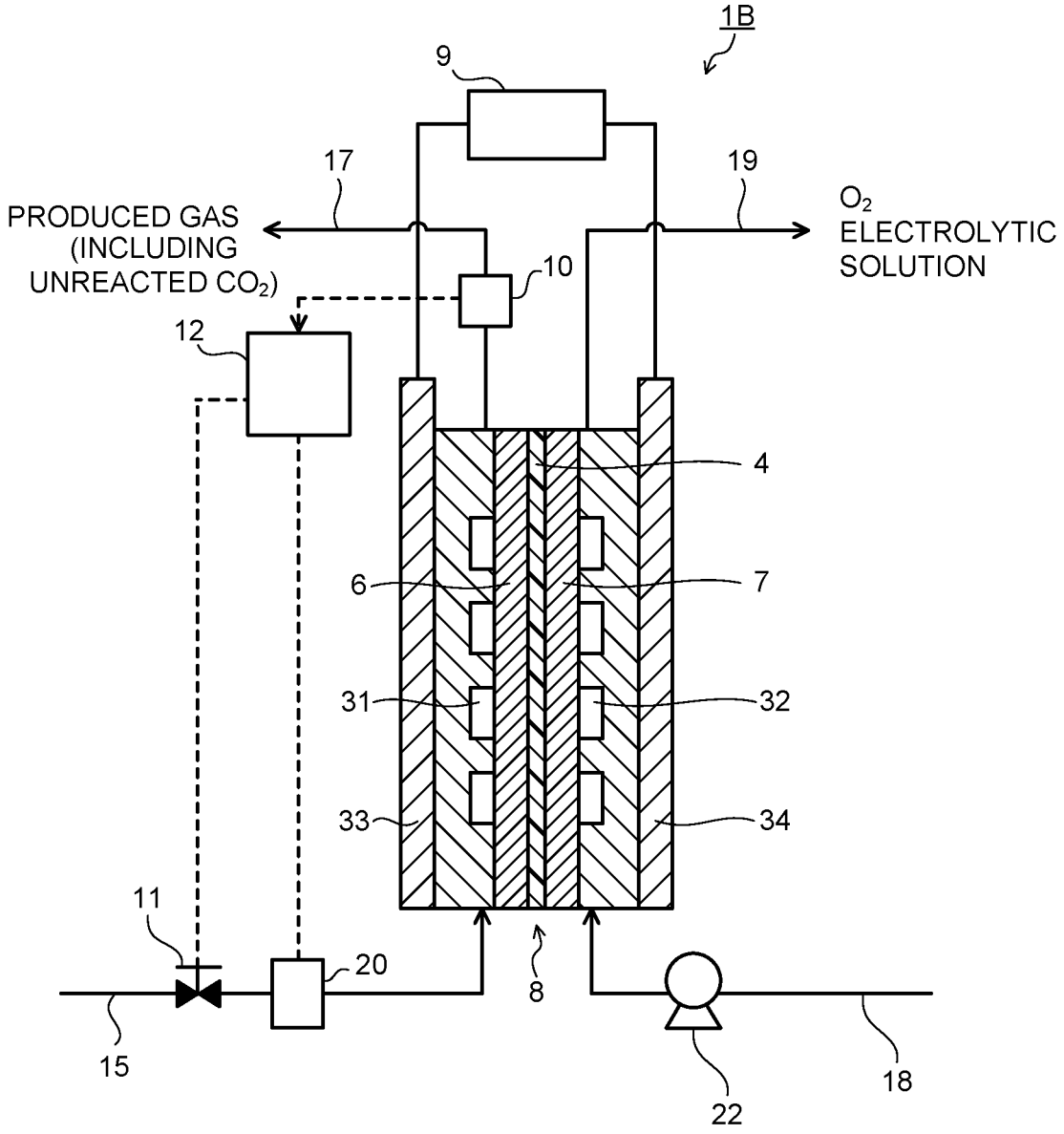
FIG. 2 is a view illustrating an electrochemical reaction device in a second embodiment.

An electrochemical reaction device 1 in a second embodiment will be described while referring to FIG. 2. An electrochemical reaction device 1B illustrated in FIG. 2 is different from the electrochemical reaction device 1A in the first embodiment in a contact type of gas containing $CO_2$ (simply described as $CO_2$ gas in some cases) with the reduction electrode 6, a contact type of a second electrolytic solution (anode solution) containing water with the oxidation electrode 7, and a connection type of the reduction electrode 6 and the oxidation electrode 7 with the power supply 9. The configurations of the respective units other than them, for example, the concrete configurations of the reduction electrode, the oxidation electrode, the diaphragm, the second electrolytic solution, the power supply, and so on, the detection of the product, the flow rate regulation based on the detection result of cell reaction, and so on are similar to those in the first embodiment. Note that in the second embodiment, it is also possible to use a first electrolytic solution containing $CO_2$ in place of the gas containing $CO_2$, or it is also possible to use gas containing water vapor in place of the second electrolytic solution containing water.

The electrochemical reaction device 1B according to the second embodiment illustrated in FIG. 2 includes an electrochemical reaction cell 8 including a reduction electrode 6, an oxidation electrode 7, a diaphragm 4, a first flow path 31 for allowing gas containing $CO_2$ or a first electrolytic solution (cathode solution) containing $CO_2$ to flow therethrough, a second flow path 32 for allowing a second electrolytic solution (anode solution) containing water to flow therethrough, a first current collector plate 33 electrically connected to the reduction electrode 6, and a second current collector plate 34 electrically connected to the oxidation electrode 7. The first and second current collector plates 33, 34 of the electrochemical reaction cell 8 are connected to a power supply 9.

There is a case where, in an operation of the above-described electrochemical reaction cell 8, a reduction product of $CO_2$ or a component of the second electrolytic solution moved to the reduction electrode 6 side is solidified to be precipitated in the first flow path 31, which blocks the first flow path 31, resulting in that the supply of gas containing $CO_2$ is stopped. For this reason, in order to suppress the formation of precipitates, the gas containing $CO_2$ desirably contains moisture. On the other hand, when a moisture amount in the gas containing $CO_2$ is excessively large, a large amount of moisture is supplied to a surface of catalyst in the reduction electrode 6, and the generation of hydrogen is likely to occur, which is not preferable. For this reason, the moisture amount in the gas containing $CO_2$ is preferably 20 to 90%, and more preferably 30 to 70% in terms of relative humidity.

To the first flow path 31, a first supply flow path 15 which supplies gas containing $CO_2$, and a first discharge flow path 17 which discharges produced gas, are connected. To the second flow path 32, a second supply flow path 18 and a second discharge flow path 19 are connected. To the first discharge flow path 17, a detection unit 10 is connected. The detection unit 10 may be an analyzer that performs at least one of gas analysis and liquid analysis, or it may also be a flowmeter that measures a flow rate of at least one of gas and liquid. When the analyzer is used as the detection unit 10, there is used an apparatus such as a gas chromatography, a high-performance liquid chromatography, or an ion chromatography capable of analyzing hydrocarbon in gas and liquid. Further, as the detection unit 10, it is also possible to use an ammeter detecting a current flowing through the electrochemical reaction cell 8 or a voltmeter detecting a voltage of the electrochemical reaction cell 8. The configuration of the detection unit 10 can be set to be similar to that of the first embodiment.

The detection signal of the cell current or the cell voltage, the production amount and the composition of the reduction reaction product, a flow rate of discharged gas, a flow rate of discharged liquid, or the like detected by the detection unit 10 is sent to a control unit 12, to thereby control an operation of a regulation unit 11. Specifically, the flow rate of the gas containing $CO_2$ to be supplied to the first flow path 31 is controlled. Note that in the second embodiment, the detection unit such as the gas analyzer or the flowmeter is not limited to be disposed in the first discharge flow path 17, and it may also be connected to the second discharge flow path 19 or disposed in both the first and second discharge flow paths 17, 19. This is because, since the reduction reaction and the oxidation reaction are opposite reactions as expressed by the aforementioned Expression (1) and Expression (2), it is possible to recognize a reaction amount on the reduction electrode 6 side by measuring a reaction amount on the oxidation electrode 7 side.

The first flow path 31 is arranged to face the reduction electrode 6. The first flow path 31 is connected to the first gas supply flow path 15, and the gas containing $CO_2$ is supplied to the first flow path 31 from the first supply flow path 15. In the first supply flow path 31, a pump (not illustrated), the regulation unit 11, and a flowmeter 20 are arranged. Although the illustration is omitted, the first supply flow path 15 is connected to a tank containing $CO_2$ gas. It is configured such that the $CO_2$ gas or the cathode solution flows through the first flow path 31 and is brought into contact with the reduction electrode 6. The $CO_2$ in the $CO_2$ gas or the cathode solution passed through the reduction electrode 6 is reduced by the reduction electrode 6. The gas or solution containing the reduction reaction product of $CO_2$ is sent to the first discharge flow path 17. The first discharge flow path 17 is provided with the detection unit 10, and is further connected to a product separation unit, a storage tank, and so on whose illustrations are omitted.

The second flow path 32 is arranged to face the oxidation electrode 7. To the second flow path 32, a solution tank or the like whose illustration is omitted is connected, and it is configured such that the anode solution flows through the second flow path 32 and is brought into contact with the oxidation electrode 7. The $H_2O$ in the anode solution passed through the oxidation electrode 7 is oxidized by the oxidation electrode. A solution containing the oxidation reaction product of $H_2O$ is sent to a second product separation unit, a storage tank, and so on whose illustrations are omitted.

In the electrochemical reaction device 1B in the second embodiment, by monitoring, with the use of the detection unit 10, the composition and the flow rate of the gas discharged from the first flow path 31, the composition and the amount of the reduction reaction product are detected. Further, when the detection unit 10 is used to monitor the cell voltage, the cell current, and the like, by previously examining the relationship (dependence) between the composition and the amount of the product, and the cell voltage and the cell current, it is possible to indirectly recognize the composition and the amount of the product from the cell voltage and the cell current. The regulation unit 11 is controlled based on the monitoring result obtained by the detection unit 10, resulting in that the flow rate of the gas containing $CO_2$ to be supplied to the first flow path 31 is regulated. Consequently, the $CO_2$ concentration in the gas discharged from the first flow path 31 is regulated to take a desired value, and is regulated to a desired state. Therefore, even if the fluctuation in the amount of supply power or reduction in the catalyst performance occurs, it becomes possible to suppress fluctuation with time in the $CO_2$ gas concentration in the produced gas, to thereby enhance the availability and utility value of the reduction reaction product.

Third Embodiment

Figure 3:
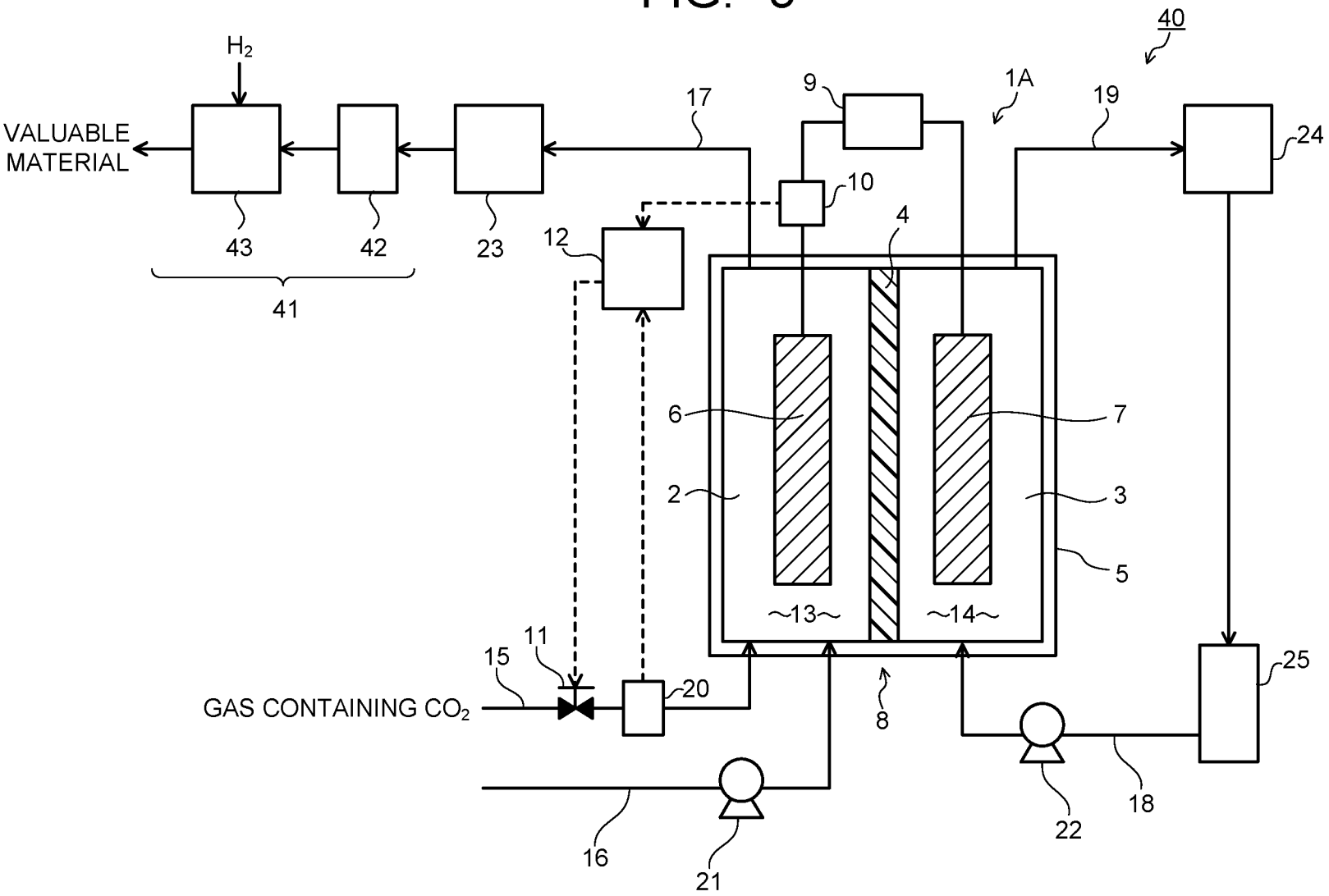
FIG. 3 is a view illustrating a valuable material manufacturing system in an embodiment.

FIG. 3 illustrates a valuable material manufacturing system 40 including the electrochemical reaction device 1 in the embodiment. Although the produced gas discharged from the first accommodation part 2 of the electrochemical reaction cell 8 may be directly utilized or consumed, by providing a chemical synthesis device at a subsequent stage of the electrochemical reaction cell 8, it becomes possible to manufacture a valuable material with high added value. FIG. 3 illustrates a configuration of the valuable material manufacturing system 40 in which the electrochemical reaction device 1 and a chemical synthesis device 41 are connected. The electrochemical reaction device 1 has a first product separator 23 provided to the first discharge flow path 17, and a second product separator 24 and a tank 25 provided to the second discharge flow path 19. The produced gas discharged from the first accommodation part 3 of the electrochemical reaction cell 8 passes through the first product separator 23 and a storage tank 42, and is sent to a chemical synthesis unit 43 to be converted into a valuable material. The first product separator 23 performs processing such as removal of moisture in the produced gas or removal of excessive $CO_2$ so that the gas with desired composition is introduced into the chemical synthesis unit 43. Note that since the $CO_2$ concentration in the produced gas is regulated in the electrochemical reaction device 1 in the embodiment, it is also possible to omit the first product separator 23.

For example, when the CO gas is produced in the electrochemical reaction cell 8 based on the above-described Expression (2), by using, as a raw material, a synthesis gas obtained by mixing the produced CO gas, and the $H_2$ gas as a by-product of the reduction reaction, methanol can be manufactured through methanol synthesis, or jet fuel or light oil can be manufactured through Fischer-Tropsch synthesis. At this time, when a large amount of unreacted $CO_2$ exists in the CO gas, there arises a problem such that a side reaction occurs during synthesis, or an adverse effect is exerted on a catalyst to be used for the synthesis, to thereby reduce yields. In the embodiment, since the $CO_2$ concentration in the CO gas is controlled, the availability and utility value of the gas produced by the reduction reaction of $CO_2$ can be enhanced. Further, in the embodiment, it is possible to perform not only the regulation of the $CO_2$ concentration in the produced gas but also the regulation of $H_2$ production being a side reaction of the aforementioned $CO_2$ reduction reaction. This is because, when the amount of gas containing $CO_2$ to be supplied to the first accommodation part 2 is increased or decreased, the production amount of $H_2$ is also decreased or increased in accordance with that.

EXAMPLES

Next, examples and their evaluation results will be described.

Example 1

Figure 4:
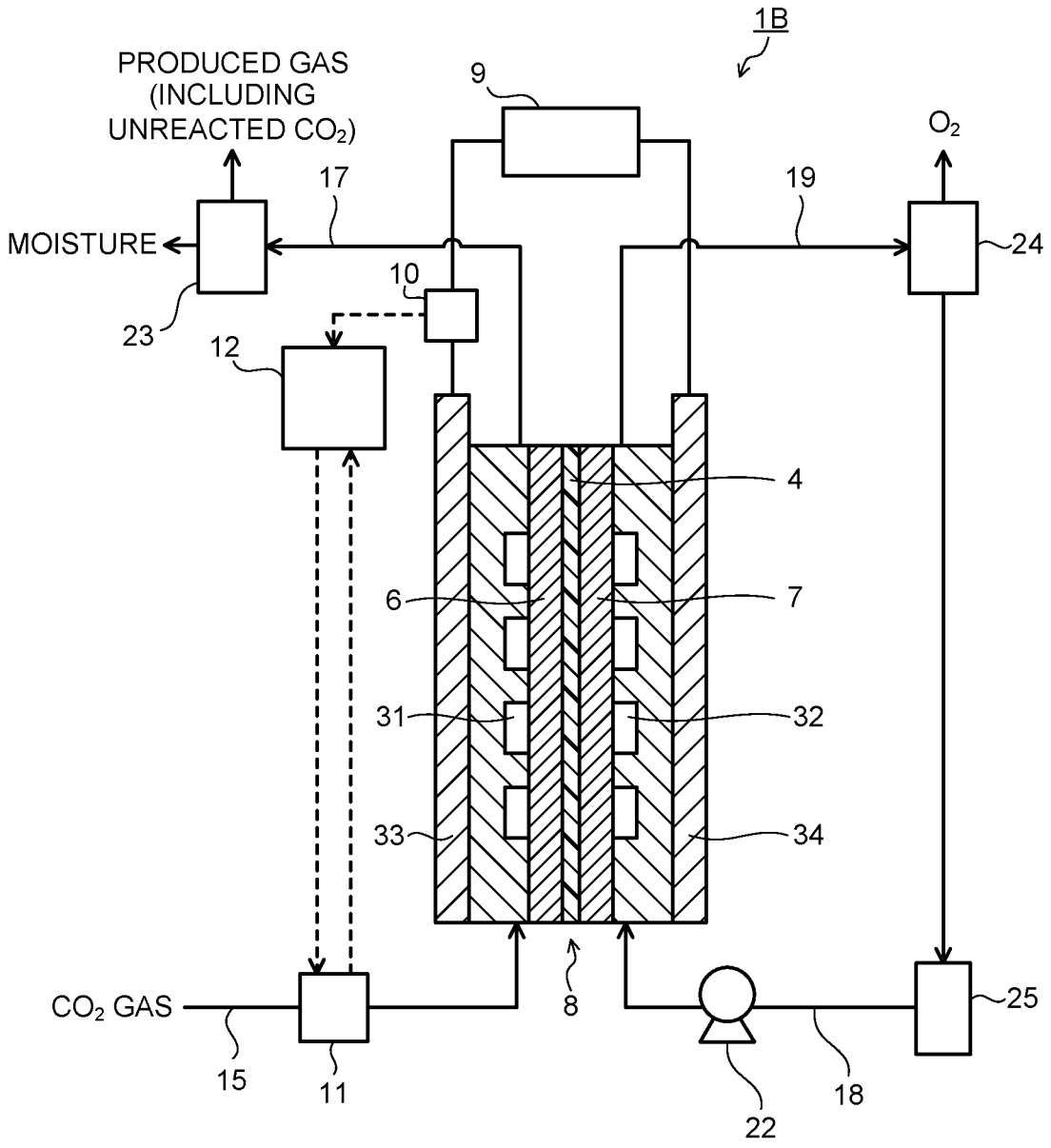
FIG. 4 is a view illustrating an electrochemical reaction device in Example 1.

An electrochemical reaction device 1B having a configuration illustrated in FIG. 4 was manufactured. The electrochemical reaction device 1B illustrated in FIG. 4 basically has the configuration similar to that of the electrochemical reaction device 1B illustrated in FIG. 2, and it corresponds to one configured by adding a gas/liquid separator 23 provided to the first discharge flow path 17, and a gas/liquid separator 24 and an electrolytic solution tank 25 provided to the second discharge flow path 19, to the electrochemical reaction device 1B illustrated in FIG. 2. Further, the detection unit 10 was provided to the wiring for supplying power to the electrochemical reaction cell 8 from the power supply 9, similarly to FIG. 1. As the regulation unit 11, a mass flow controller was used.

First, the electrochemical reaction device 1B was used to control the flow rate of $CO_2$ gas to be supplied to the first flow path 31, to thereby carry out verification whether the $CO_2$ concentration in the gas discharged from the first flow path 31 was controllable. In this verification experiment, the control unit was not operated, and the reading of the detection unit 10 and the operation of the regulation unit were artificially operated.

As the reduction electrode 6 used in the electrochemical reaction cell 8, one obtained by coating carbon particles having gold nanoparticles supported thereon onto a carbon paper was used. An average grain diameter of the gold nanoparticles was 3 nm, and a support amount was 10 mass %. As the oxidation electrode 7, an electrode obtained by coating $IrO_2$ nanoparticles onto Ti mesh was used. Further, as the diaphragm, an anion exchange membrane was used. Note that each of the reduction electrode 6 and the oxidation electrode 7 was cut to be used so that an electrode area became 4 $cm^2$. As illustrated in FIG. 4 which indicates the structure of the electrochemical reaction cell 8, the first current collector plate 33, the first flow path 31, the reduction electrode 6, the diaphragm 4, the oxidation electrode 7, the second flow path 32, and the second current collector plate 34 were stacked in this order from the top, and were sandwiched by a not-illustrated support plate, to thereby form the electrochemical reaction cell 8.

The above-described electrochemical reaction cell 8 was connected to the solution system and the gas system, and was operated under the following conditions. To the first flow path 31, the $CO_2$ gas (purity: >99.99%) was introduced to satisfy a predetermined flow rate by using a mass flow controller, and a liquid trap as the gas/liquid separator 23 was provided at a flow path outlet. Further, 300 ml of an aqueous potassium hydrogen carbonate solution ($KHCO_3$ with a concentration of 0.1 M) was flowed at a flow rate of 10 mL/min to be circulated through the second flow path 32. Next, for the power supply, a DC stabilized power supply was used for a verification experiment, the power supply was connected to the reduction electrode 6 and the oxidation electrode 7, and by making a predetermined current flow, the reduction reaction of $CO_2$ was performed, and a value of a cell voltage at that time was collected.

A part of the produced gas discharged from the gas/liquid separator 23 on the first flow path 31 side was collected, and a production amount of the CO or $H_2$ gas produced through the $CO_2$ reduction reaction or the reduction reaction of water was analyzed by using a gas chromatograph. The $CO_2$ concentration in the produced gas was analyzed by using a $CO_2$ sensor of NDIR (Non Dispersive Infrared) type. As a result of the analysis using the gas chromatograph and the $CO_2$ sensor, only CO, $H_2$, and $CO_2$ were detected as components contained in the produced gas, and in all measurements, selectivity of CO (CO production amount/(CO production amount+$H_2$ production amount)) was 98% or more.

Figure 5:
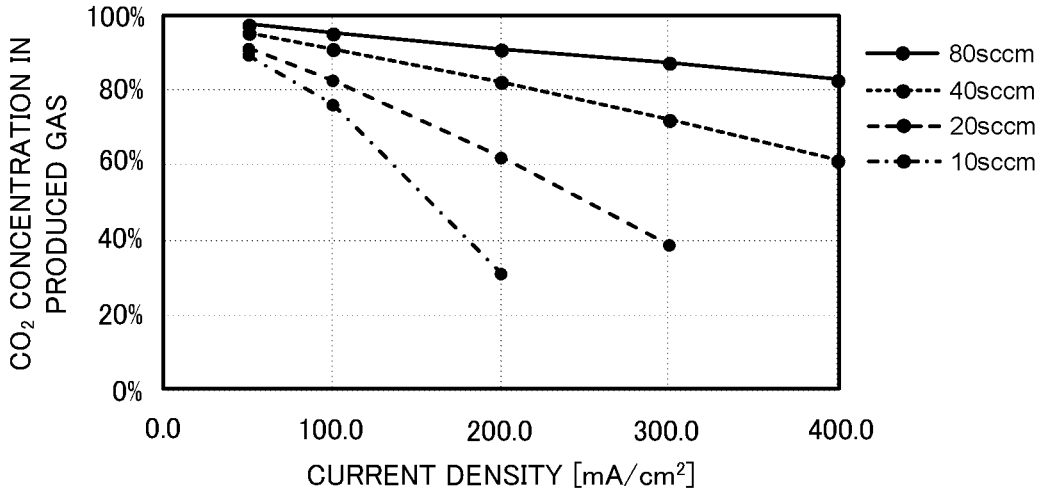
FIG. 5 is a view illustrating a relationship between a current density and a $CO_2$ concentration in a produced gas when a flow rate of $CO_2$ to be supplied to a cell in the electrochemical reaction device in Example 1 is changed.

FIG. 5 illustrates a relationship between a current density and a $CO_2$ concentration in a produced gas when a flow rate of $CO_2$ to be supplied to the electrochemical reaction cell 8 is changed. From FIG. 5, it is possible to recognize a state where the $CO_2$ concentration in the produced gas decreases as the current density increases, at each of the $CO_2$ flow rates. This is because the supplied $CO_2$ is converted into CO since the current density is in proportion to the reaction amount of the electrochemical reaction.

For example, in the case where the CO2 flow rate is 20 sccm in FIG. 5, when the current density is changed from 50 mA/cm2 to 300 mA/cm2, the CO2 concentration in the produced gas is reduced to about 40% from about 90%. This means that when the amount of supply power to the cell changes, the CO2 concentration in the produced gas also changes. Therefore, according to the embodiment, the value of current that flows through the cell is detected, and the amount of CO2 to be supplied to the cell is regulated by the control unit, resulting in that the CO2 concentration in the produced gas can be set to constant. For example, in a case where the operation is performed with the CO2 supply amount of 40 sccm and the current density of 200 mA/cm2 as initial operating conditions, to obtain a produced gas with a CO2 concentration of about 80%, if the current density is lowered to 100 mA/cm2 due to power fluctuation, the current value is measured to set the flow rate of CO2 to be supplied to about 20 sccm, resulting in that the CO2 concentration in the produced gas can be kept to 80%. Note that although the ammeter was used as the detection unit in Example 1, a similar effect can be obtained also in a case where the detection unit measures the voltage of the cell.

Example 2

In Example 2, a gas analyzer was used as the detection unit 10 in the electrochemical reaction device 1B having the configuration illustrated in FIG. 2 to control the flow rate of $CO_2$ gas to be supplied to the first flow path 31, to thereby carry out verification whether the $CO_2$ concentration in the gas discharged from the first flow path 31 was controllable. Note that also in this verification experiment, the control unit was not operated, and the reading of the detection unit and the operation of the regulation unit were artificially operated, similarly to Example 1.

The measurement was performed while using the electrochemical reaction cell and employing the operating conditions similarly to Example 1. The electrochemical reaction cell was connected to the solution and gas systems illustrated in FIG. 2, and an operation was performed by arranging a gas chromatograph analyzer as the detection unit in the first discharge flow path. Similarly to Example 1, only CO, $H_2$, and $CO_2$ were detected as components contained in the produced gas, and in all measurements, selectivity of CO (CO production amount/(CO production amount+$H_2$ production amount)) was 98% or more.

Figure 6:
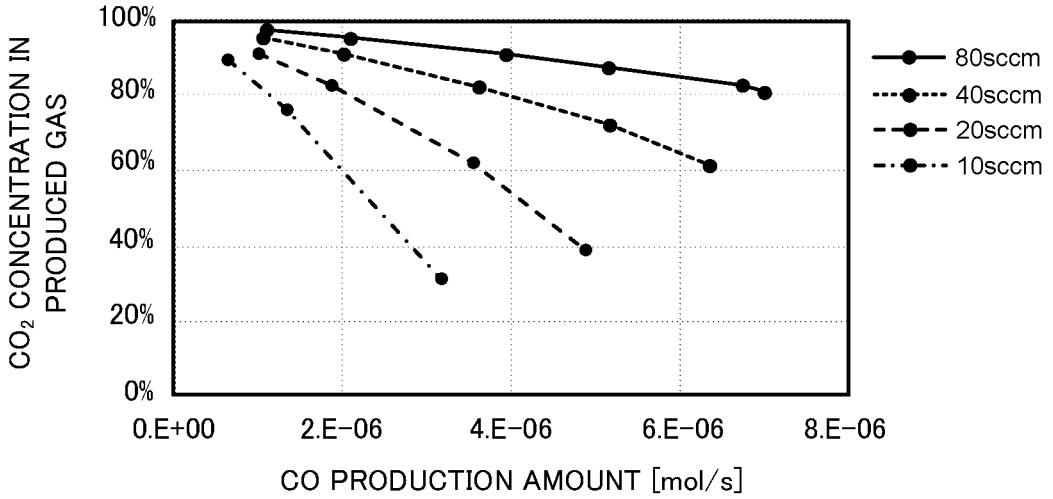
FIG. 6 is a view illustrating a relationship between a CO production amount and a $CO_2$ concentration in a produced gas when a flow rate of $CO_2$ to be supplied to a cell in an electrochemical reaction device in Example 2 is changed.

FIG. 6 illustrates a relationship between the CO production amount and the $CO_2$ concentration in the produced gas when the flow rate of $CO_2$ to be supplied to the cell is changed. The CO production amount indicates a CO production amount in the produced gas measured by the gas chromatograph arranged in the first discharge flow path. From FIG. 6, it can be confirmed that there is a correlation between the CO production amount and the $CO_2$ concentration at each of the $CO_2$ flow rates, and it can be understood that the $CO_2$ concentration in the produced gas can be determined by detecting the CO production amount. Further, it can be understood that, when the CO production amount is changed due to the fluctuation in the amount of supply power, the change in catalyst activity, or the like, the $CO_2$ concentration in the produced gas can be controlled by changing the $CO_2$ flow rate. Note that although Example 2 indicates that the $CO_2$ concentration can be controlled by detecting the CO production amount in the produced gas and regulating the flow rate of $CO_2$ to be supplied, a similar effect can be obtained also in a case where the detection target is set to hydrogen in the produced gas obtained by the side reaction or oxygen discharged from the second accommodation part.

Example 3

Figure 7:
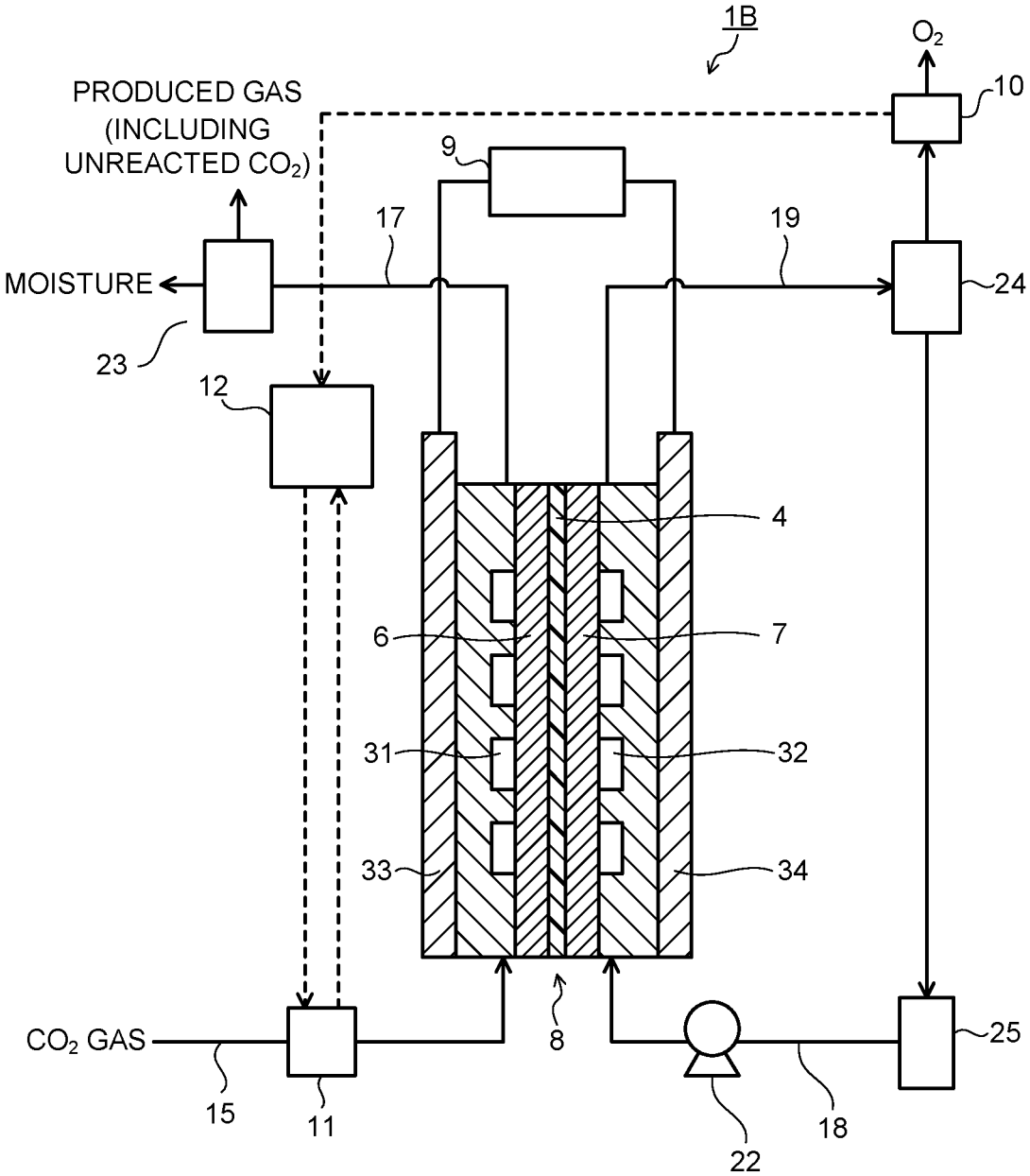
FIG. 7 is a view illustrating an electrochemical reaction device in Example 3.

In Example 3, a gas flowmeter was used as the detection unit 10 in the electrochemical reaction device having the configuration illustrated in FIG. 7 to control the flow rate of $CO_2$ gas to be supplied to the first flow path 31, to thereby carry out verification whether the $CO_2$ concentration in the gas discharged from the first flow path 31 was controllable. The detection unit 10 was disposed in the second discharge flow path 19. Note that in this verification experiment, the control unit was not operated, and the reading of the detection unit and the operation of the regulation unit were artificially operated, similarly to Example 1.

The measurement was performed while using the electrochemical reaction cell and employing the operating conditions similarly to Examples 1, 2. The electrochemical reaction cell was connected to the solution and gas systems illustrated in FIG. 7, and an operation was performed by arranging a flowmeter that measures a flow rate of the gas discharged from the second gas/liquid separator, as the detection unit. Note that to the second gas/liquid separator, an argon gas being an inert gas was separately introduced for degassing oxygen dissolved in the electrolytic solution. As a result of this, the total flow rate of the gas discharged from the second gas/liquid separator was about 200 sccm. Similarly to Examples 1, 2, only CO, $H_2$, and $CO_2$ were detected as components contained in the produced gas, and in all measurements, selectivity of CO (CO production amount/(CO production amount+$H_2$ production amount)) was 98% or more.

Figure 8:
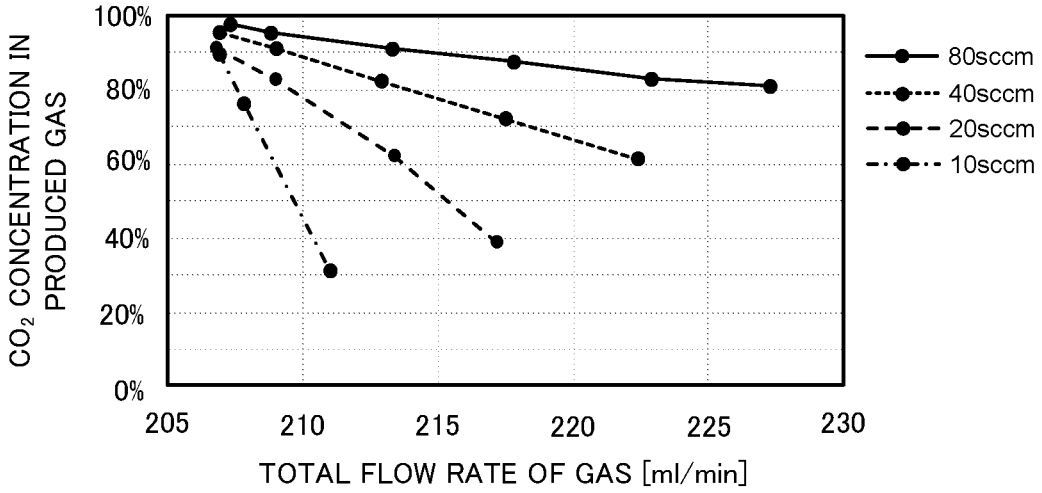
FIG. 8 is a view illustrating a relationship between a total flow rate of gas discharged from an anode side of a cell in the electrochemical reaction device in Example 3 and a $CO_2$ concentration in a produced gas when a flow rate of $CO_2$ to be supplied to the cell is changed.

FIG. 8 illustrates a relationship between the total flow rate of gas discharged from the second gas/liquid separator and the $CO_2$ concentration in the produced gas when the flow rate of $CO_2$ to be supplied to the cell is changed. From FIG. 8, it can be confirmed that there is a correlation between the total flow rate of gas and the $CO_2$ concentration at each of the $CO_2$ flow rates, and it can be understood that the $CO_2$ concentration in the produced gas can be determined by detecting the flow rate of gas. Further, it can be understood that, when the CO production amount is changed due to the fluctuation in the amount of supply power, the change in catalyst activity, or the like, the $CO_2$ concentration in the produced gas can be controlled by changing the $CO_2$ flow rate. Note that although Example 3 indicates that the $CO_2$ concentration can be controlled by detecting the total flow rate of gas discharged from the second accommodation part and regulating the flow rate of $CO_2$ to be supplied, a similar effect can be obtained also in a case where the flow rate of gas discharged from the first accommodation part is detected.

Note that the above-described configurations in the respective embodiments are applicable in combination, and parts thereof are also replaceable. While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrochemical reaction method, comprising:

supplying gas containing carbon dioxide to a first flow path of an electrochemical reaction cell so that the gas is in contact with a reduction electrode, and supplying an electrolytic solution containing water or water vapor to a second flow path of the electrochemical reaction cell so that the electrolytic solution or water vapor is in contact with a oxidation electrode, wherein the electrochemical reaction cell comprises the first flow path, the second flow path, the reduction electrode, the oxidation electrode, and a diaphragm provided between the reduction electrode and the oxidation electrode, the reduction electrode having a first surface and a second surface opposite to the first surface, the first flow path facing on the first surface, the diaphragm being in contact with the second surface;

applying a voltage to the electrochemical reaction cell from a power supply connected to the reduction electrode and the oxidation electrode, to reduce carbon dioxide and thus produce a carbon compound, and to oxidize water and thus produce oxygen;

discharging a mixing gas containing a produced gas with the reduction electrode and an unreacted carbon dioxide from the first flow path and a mixture containing the electrolytic solution or water vapor and a produced gas with the oxidation electrode from the second flow path;

measuring at least one of a first flow rate of the mixing gas discharged from the first flow path and a second flow rate of the mixture discharged from the second flow path to obtain a flow rate signal of at least one of the mixing gas and the mixture as a detection signal; and controlling an amount of the gas containing the carbon dioxide to be supplied to the first flow path based on a control signal which is obtained by converting the flow rate signal in consideration of temperature information inside the electrochemical reaction cell so that a concentration of the unreacted carbon dioxide in the mixing gas discharged from the first flow path takes a desired value, wherein the concentration of the unreacted carbon dioxide in the mixing gas discharged from the first flow path is controlled in a desired value by measuring a flow rate of a second gas discharged from the second flow path and adjusting a flow rate of the gas containing the carbon dioxide to be supplied to the first flow path when an allowable carbon dioxide concentration of the first gas discharged from the first flow path is denoted as $\Delta y$, where $\Delta y$ is a numerical value, and a flow rate of the second gas per a unit electrode area varies within a range of $-\Delta y/0.5665$ ml/min/cm$^2$ or more and $-\Delta y/0.0335$ ml/min/cm$^2$ or less.

2. The method according claim 1, wherein the amount of the gas containing the carbon dioxide to be supplied to the first flow path is controlled so as to increase when the flow rate signal rises, and to reduce when the flow rate signal the detection signal decreases.

3. The method according claim 1, wherein the power supply is a variable renewable power supply which comprises an electrical source that converts kinetic energy or potential energy of wind power, water power, geothermal power, or tidal power into electric energy, a solar cell including a photoelectric conversion element that converts light energy into electric energy, a fuel cell that converts chemical energy into electric energy, or an electrical source that converts vibrational energy into electric energy, and the amount of the gas containing the carbon dioxide to be supplied to the first flow path is controlled depending on a change of electrical power output by the variable renewable power supply.

4. The method according to claim 1, wherein the gas containing the carbon dioxide to be supplied to the first flow path has moisture amount of 20% or more and 90% or less in terms of relative humidity.

5. The method according to claim 1, wherein the electrochemical reaction cell does not comprise any flow path distinct from the first flow path and the second flow path so as to directly supply a electrolytic solution containing water or water vapor to the reduction electrode.

6. An electrochemical reaction method, comprising:

supplying gas containing carbon dioxide to a first flow path of an electrochemical reaction cell so that the gas is in contact with a reduction electrode, and supplying an electrolytic solution containing water or water vapor to a second flow path of the electrochemical reaction cell so that the electrolytic solution or water vapor is in contact with a oxidation electrode, wherein the electrochemical reaction cell comprises the first flow path, the second flow path, the reduction electrode, the oxidation electrode, and a diaphragm provided between the reduction electrode and the oxidation electrode, the reduction electrode having a first surface and a second surface opposite to the first surface, the first flow path facing on the first surface, the diaphragm being in contact with the second surface;

applying a voltage to the electrochemical reaction cell from a power supply connected to the reduction electrode and the oxidation electrode, to reduce carbon dioxide and thus produce a carbon compound, and to oxidize water and thus produce oxygen;

discharging a mixing gas containing a produced gas with the reduction electrode and an unreacted carbon dioxide from the first flow path and a mixture containing the electrolytic solution or water vapor and a produced gas with the oxidation electrode from the second flow path;

measuring at least one of a first flow rate of the mixing gas discharged from the first flow path and a second flow rate of the mixture discharged from the second flow path to obtain a flow rate signal of at least one of the mixing gas and the mixture as a detection signal; and controlling an amount of the gas containing the carbon dioxide to be supplied to the first flow path based on a control signal which is obtained by converting the flow rate signal in consideration of temperature information inside the electrochemical reaction cell so that a concentration of the unreacted carbon dioxide in the mixing gas discharged from the first flow path takes a desired value, wherein the concentration of the unreacted carbon dioxide in the mixing gas discharged from the first flow path is controlled in a desired value by measuring a flow rate of a second gas discharged from the second flow path and adjusting a current density of the electrochemical reaction cell when an allowable carbon dioxide concentration of the first gas discharged from the first flow path is denoted as $\Delta y$, where $\Delta y$ is a numerical value, and a flow rate of the second gas per a unit electrode area of the oxidation electrode varies within a range of $-\Delta y/0.5665$ ml/min/cm$^2$ or more and $-\Delta y/0.0335$ ml/min/cm$^2$ or less.

7. The method according claim 6, wherein the amount of the gas containing the carbon dioxide to be supplied to the first flow path is controlled so as to increase when the flow rate signal rises, and to reduce when the flow rate signal the detection signal decreases.

8. The method according claim 6, wherein the power supply is a variable renewable power supply which comprises an electrical source that converts kinetic energy or potential energy of wind power, water power, geothermal power, or tidal power into electric energy, a solar cell including a photoelectric conversion element that converts light energy into electric energy, a fuel cell that converts chemical energy into electric energy, or an electrical source that converts vibrational energy into electric energy, and the amount of the gas containing the carbon dioxide to be supplied to the first flow path is controlled depending on a change of electrical power output by the variable renewable power supply.

9. The method according to claim 6, wherein the gas containing the carbon dioxide to be supplied to the first flow path has moisture amount of 20% or more and 90% or less in terms of relative humidity.

10. The method according to claim 6, wherein the electrochemical reaction cell does not comprise any flow path distinct from the first flow path and the second flow path so as to directly supply a electrolytic solution containing water or water vapor to the reduction electrode.

* * * * *